United States Patent [19]

Jones, Jr. et al.

[11] 4,305,078

[45] Dec. 8, 1981

[54] MULTIFREQUENCY SERIES-FED EDGE SLOT ANTENNA

[75] Inventors: Howard S. Jones, Jr., Washington, D.C.; Daniel H. Schaubert, Silver Spring, Md.

[73] Assignee: The United States of America as represented by the Secretary of the Army, Washington, D.C.

[21] Appl. No.: 84,686

[22] Filed: Oct. 15, 1979

[51] Int. Cl.[3] ..... H01Q 1/28

[52] U.S. Cl. ..... 343/708; 343/705; 343/769

[58] Field of Search ..... 343/705, 708, 700 MS, 343/769, 776

[56] References Cited

U.S. PATENT DOCUMENTS

| | | | |
|---|---|---|---|
| 4,051,480 | 9/1977 | Reggia et al. | 343/769 |
| 4,162,499 | 7/1979 | Jones, Jr. et al. | 343/700 MS |
| 4,185,289 | 1/1980 | De Santis et al. | 343/769 |

*Primary Examiner*—David K. Moore

*Attorney, Agent, or Firm*—Nathan Edelberg; Robert P. Gibson; Saul Elbaum

[57] ABSTRACT

A single input multifrequency antenna is disclosed which comprises a plurality of radiating elements connected in series. The device may comprise multiple conformal edge slot radiators.

7 Claims, 9 Drawing Figures

1620 MHz

2720 MHz

MULTIFREQUENCY SERIES-FED EDGE SLOT ANTENNA

RIGHTS OF THE GOVERNMENT

The invention described herein may be manufactured, used and licensed by or for the U.S. for governmental purposes without the payment to us of any royalty thereon.

BACKGROUND OF THE INVENTION

The conformal edge slot radiator is a good antenna for applications that require an antenna to conform to the exterior dimensions of a conical or cylindrical body such as a re-entry vehicle. U.S. Pat. No. 4,051,480 discloses an edge slot radiator which is capable of emitting azimuthally symmetric radiation in a single, narrow band of frequencies. The device of the patent comprises generally a dielectric substrate having a plurality of holes positioned in radial lines over the substrate, the conductive plating on the opposed surfaces of the substrate acting as radiating elements, a plurality of inductive shorting posts formed in the holes, and input means for exciting the radiating elements. Simply by increasing the number of inductive posts one can raise the operating frequency of the antenna without changing its physical dimensions. While this device functions well, it suffers from the limitation that it is capable of radiating only in a single, narrow band of frequencies.

For applications requiring multifrequency or broader band radiation the prior art devices are inadequate. It is an object of this invention to overcome the drawbacks of the prior art antennas.

Accordingly, it is an object of the invention to provide a multifrequency antenna, capable of radiating at multiple frequencies from a single input.

It is also an object of the invention to provide such an antenna wherein the frequencies radiated may be selectively varied whereby the artisan may design an antenna suited to particular needs.

It is a further object of the invention to design a multifrequency antenna which is readily capable of conforming to the exterior dimensions of a projectile or reentry vehicle.

The present invention achieves these objectives by providing several modified dielectric loaded edge slot radiators connected in series fashion. Each radiator may be tuned to radiate at a distinct frequency.

DESCRIPTION OF THE PREFERRED EMBODIMENTS

Figure 1A:
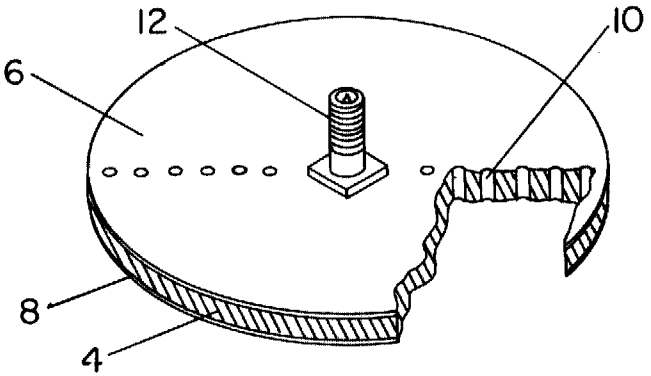
FIG. 1A shows a first embodiment of a dielectric loaded edge slot radiator according to the present invention.

FIG. 1A shows a first embodiment of the invention. The overall structure of the edge slot radiator of the present invention is very similar to that shown in the above mentioned U.S. Pat. No. 4,051,480. The radiator comprises dielectric substrate 4 and metalclad surfaces 6 and 8, usually of copper. A number of holes 10 pass through the substrate and are arranged in radial lines. The holes are plated through with copper to form inductive posts which in turn form boundaries for individual radiating elements.

Figure 1B:
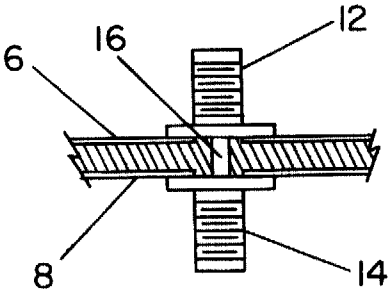
FIG. 1B illustrates in greater detail the input and output connectors of the edge slot radiator of FIG. 1A.

While the edge slot radiator of the aforementioned patent comprises simply a single coaxial input, the present device comprises a coaxial input 12 and a coaxial output 14, as seen more clearly in FIG. 1B. The outer conductor of the coaxial input 12 is in electrical contact with metal surface 6 of the radiator, while the outer conductor of coaxial output 14 is in contact with the metal surface 8. The inner conductor 16 of the coaxial connectors passes through the radiator substrate without contacting either metallic surface.

The number of plated through holes 10 in a given radial line may be varied in order to tune the operating frequency of the antenna. Also the number of radial lines may be varied in order to alter the number of radiating elements in each edge slot radiator, as taught in U.S. Pat. No. 4,051,480 which is incorporated herein by reference.

Figure 3:
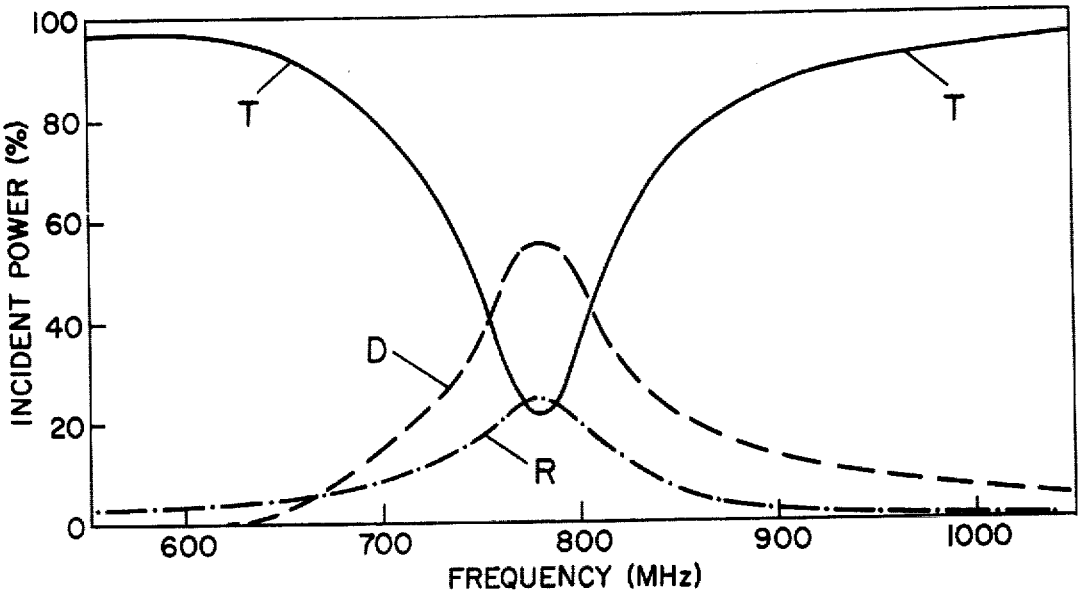
FIG. 3 is a graphical illustration depicting the manner of operation of a single edge slot radiator as shown in FIG. 1A.

The success of the series-fed dielectric filled edge slot (SDE) antenna is due to it transmission properties at frequencies away from its operating band. FIG. 3 shows the transmission, reflection, and dissipation characteristics of a 7.6 centimeter diameter SDE antenna mounted at the center of a 15 centimeter long cylinder. The solid line curve T shows that except near the operating frequency, the SDE antenna transmits most of the incident power to the output coaxial line. This power is then transmitted to the next succeeding radiator in a series of radiators. At the operating frequency of 785 MHz, approximately 25% of the incident power is reflected, as illustrated by chainlink curve R, 25% is transmitted, and 50% is dissipated by the edge slot radiator, as indicated by dashed curve D. Previous measurements have shown that the basic dielectric filled edge slot antenna is an efficient radiator, so most of the dissipated power goes into the desired radiation field.

Figure 2A:
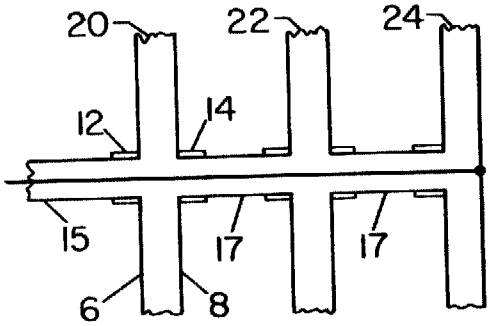
FIGS. 2 and 2A illustrate an embodiment of the invention comprising three edge slot radiators, as shown in FIGS. 1A and 1B, incorporated into a cylindrical body.
Figure 2:
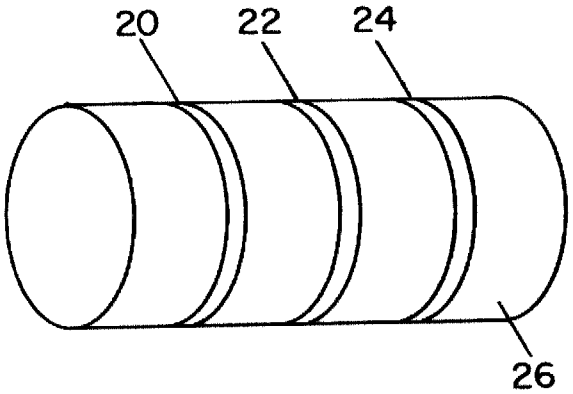
Figure 4:
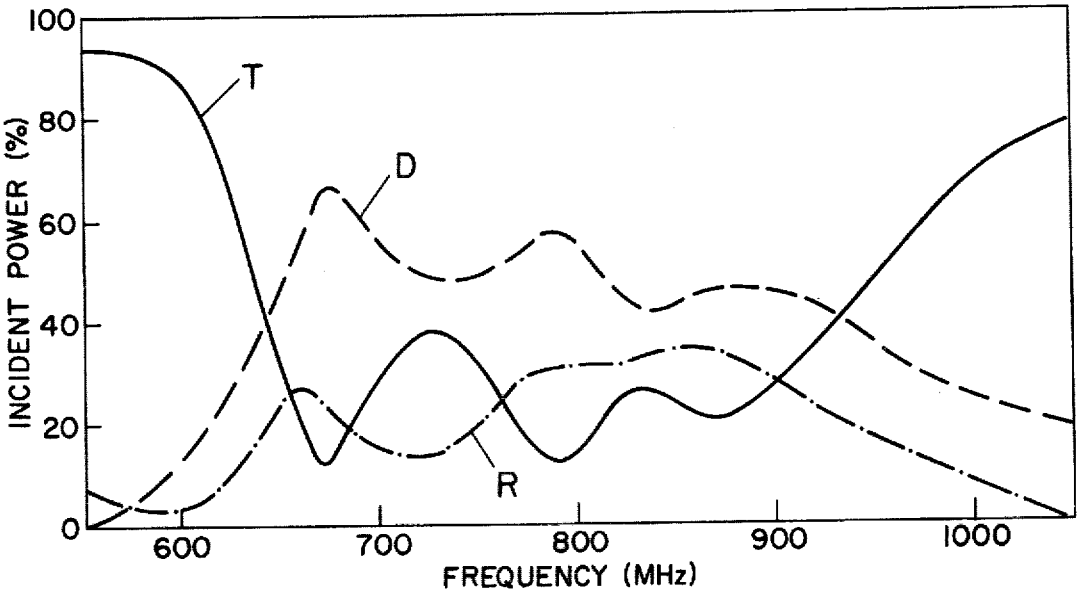
FIG. 4 is a similar graphical illustration depicting the manner of operation of a set of three radiators, as shown in FIG. 2, connected in series.

Three SDE radiators were mounted in a 30.2 centimeter long cylinder, as shown in FIGS. 2 and 2A, and were interconnected with cables 17 having an electrical length of 28.7 centimeters. The transmission, dissipation, and reflection characteristics of this 3 radiator model are shown in FIG. 4, represented by the curves T, D, and R, respectively. The radiators 20, 22 and 24, mounted in cylinder 26 are 1-, 2-, and 3- post radiators. The model is fed via coaxial input 15 from the end nearest the 3 post radiator 20. The dissipation maxima at 675, 790, and 875 MHz correspond to the transmission minima and agree well with predicted operating frequencies for 1-, 2-, and 3- post antennas. The radiation patterns of this multi-radiator model are essentially omnidirectional in the azimuthal plane. The elevation plane patterns are controlled by the size of the cylinder and the locations of the radiators on the cylinder.

Figure 5:
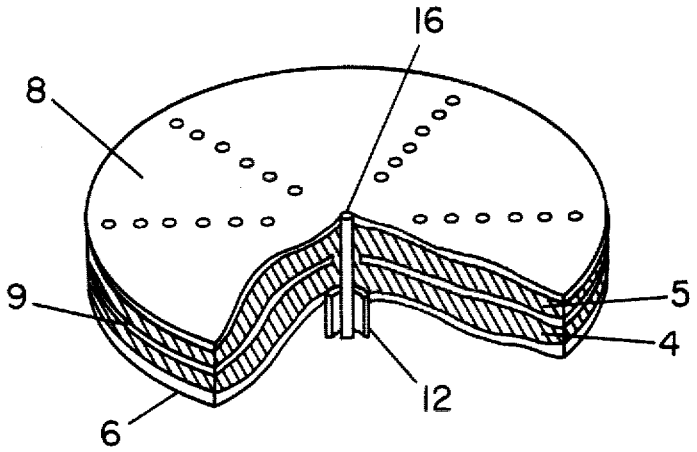
FIG. 5 illustrates a second embodiment of the invention.

FIG. 5 shows a second embodiment of the invention. As can be seen in this figure, it is not necessary to separate the antennas on the cylinder. FIG. 5 depicts two radiators, each with six radiating elements, stacked together. The device comprises a dielectric substrate having copper clad surfaces 6 and 8, as previously described. The substrate is separated into distinct layers 4 and 5 by means of a copper layer 9. Although a two radiator stack is shown, any number of layers may be formed to create the desired number of edge slot radiators in the antenna. Also, by using a different number of radial lines and/or a different number of posts in each radial line for each distinct layer, a thin, multi-frequency antenna with omnidirectional radiation coverage may be obtained. The outer conductor 12 of the coaxial input is electrically connected to metallic layer 6, while the inner conductor 16 is electrically connected to the metallic surface 8. Conductor 16 passes through the intermediate layer or layers 9 without making electrical contact therewith.

Figure 6:
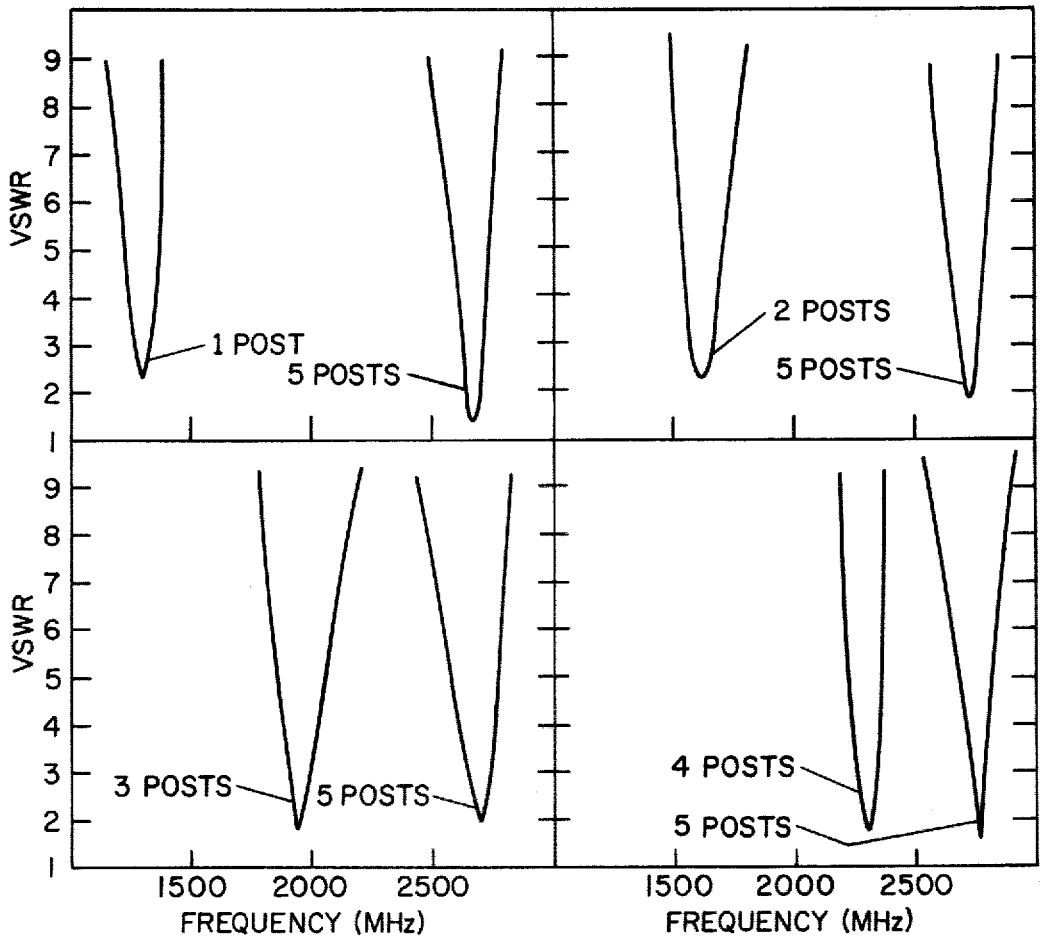
FIG. 6 comprises several graphical illustrations of the operating characteristics of several embodiments of the invention as shown in FIG. 5.

Incident input power fed to the antenna by means of the coaxial input 12, 16 will be radiated from the respective edge slot radiators at differing frequencies depending on the physical characteristics of the respective radiators. The voltage standing wave ratio (VSWR) characteristics for four configurations of this antenna are shown in FIG. 6. The four configurations each were composed of two edge slot radiators as shown in FIG. 5. It can be seen that for a radiator having a selected number of inductive posts the VSWR will be at a minimum at the operating frequency of the radiator. This will permit the radiator to dissipate a maximum amount of input energy into the radiation field.

In the configuration represented in FIG. 4, as well as each of the configurations represented in FIG. 6, the respective edge slot radiators emit radiation at separate and distinct frequencies. One may tune the various edge slot radiators to emit radiation at relatively closely spaced frequencies. The radiation emitted by such a device would appear to be emitted at a single, very broad band of frequencies.

Figure 7:
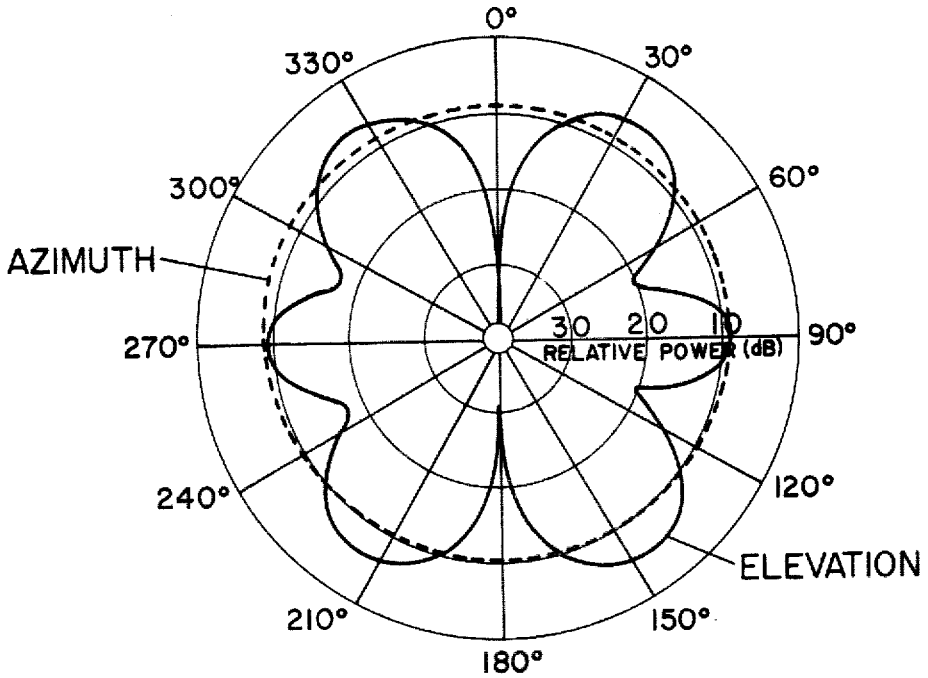
FIGS. 7 and 8 show typical radiation patterns of a device as shown in FIG. 5.
Figure 8:
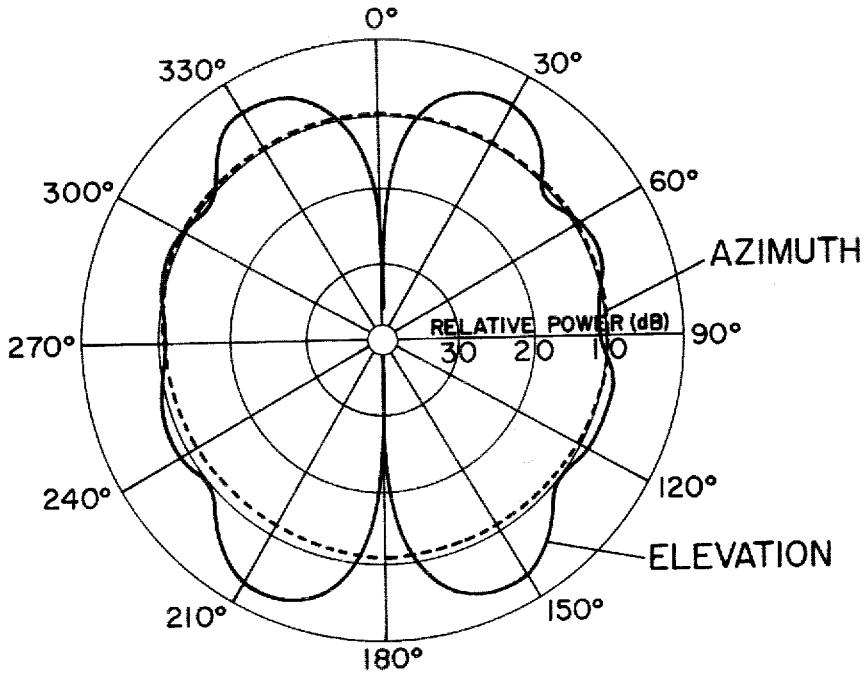

Typical radiation patterns for a device as shown in FIG. 5 are shown in FIGS. 7 and 8. FIG. 7 shows the radiation pattern of a 2-post stacked antenna, while FIG. 8 shows the radiation pattern of a 5- post stacked antenna. Both were mounted at the center of a 45 centimeter long cylinder. The excellent azimuthal plane symmetry, represented by the dashed curve, is characteristic of edge slot radiators. The elevation plane patterns are controlled by the size of the cylinder and the location of the antennas on the cylinder.

It can be seen that the invention provides a multi-frequency series-fed edge slot antenna capable of emitting radiation at multiple frequencies. The device readily conforms to the exterior surface of projectiles or other bodies of cylindrical or conical configuration, and is relatively simple and inexpensive to fabricate. Although several embodiments of this invention have been illustrated in the accompanying drawings and foregoing specification, it should be understood by those skilled in the art that various changes such as relative dimension, number of antennas, configuration, and materials used, as well as the suggested manner of use of the invention, may be made therein without departing from the spirit and scope of the invention.

We claim:

1. A series-fed dielectric-filled antenna which allows operation at two or more independently selected frequencies, comprising at least two edge slot radiators comprising a dielectric substrate, a conductive plating on opposed exterior surfaces of said substrate, and at least one layer of conductive material within the substrate disposed in generally parallel relation to said exterior surfaces for separating the substrate into distinct edge slot radiators, each of said edge slot radiators comprising means for radiating at a different frequency, and a single coaxial line connecting said radiators in series, said coaxial line has one conductor thereof in conductive contact with one of said exterior plated surfaces, and the other conductor thereof in conductive contact with the other exterior plated surface.

2. An antenna as in claim 1, wherein each edge slot radiator comprises a plurality of conductive posts positioned in radial lines thereby dividing the radiator into radiating elements, whereby the number of radiating elements in each radiator may be varied by varying the number of radial lines of posts, and the frequency output may be tuned by varying the number of posts in the radial lines.

3. An antenna as in claim 1, in combination with a cylindrical body, the radiators having a circular shape the circumference of which conforms to the surface of the cylindrical body.

4. A series-fed dielectric-filled antenna which allows operation at two or more independently selected frequencies comprising:

at least two dielectric loaded edge slot radiators, each edge slot radiator comprising means for radiating at a different frequency and comprising a dielectric substrate having a conductive plating on opposed surfaces thereof, signal input means comprising a single coaxial line connecting said radiators in series and connected to each radiator at the center thereof, the inner conductor of said coaxial line is in electrical contact with the conductive plating on one side of the last radiator in said series, and the outer conductor of said coaxial line is in electrical contact with every other conductive plating on said at least two radiators.

5. An antenna as in claim 4, wherein the respective edge slot radiators are circular in shape and are arranged at spaced axial positions along a cylindrical body, the circumference of each radiator conforming to the peripheral surface of the cylindrical body.

6. An antenna as in claim 4, wherein each radiator comprises a plurality of inductive posts positioned in radial lines thereby defining radiating elements, whereby the number of radiating elements in such radiator may be varied by varying the number of radial lines of posts.

7. An antenna as in claim 4, wherein each radiator comprises a plurality of inductive posts positioned in radial lines thereby defining radiating elements in each radiator, whereby the frequency output of the radiator may be tuned by varying the number of posts in the radial lines.

* * * * *